US009735515B2

(12) United States Patent
Wu et al.

(10) Patent No.: US 9,735,515 B2
(45) Date of Patent: Aug. 15, 2017

(54) ELASTIC-CLIP JUNCTION BOX STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Cherng Shin Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/980,290

(22) Filed: Dec. 28, 2015

(65) Prior Publication Data

US 2016/0240940 A1 Aug. 18, 2016

(30) Foreign Application Priority Data

Feb. 17, 2015 (TW) ..... 104202863 U

(51) Int. Cl.

| | |
|---|---|
| ***H01R 4/48*** | (2006.01) |
| ***H01R 11/03*** | (2006.01) |
| ***H01R 13/70*** | (2006.01) |
| *H01R 9/24* | (2006.01) |
| *H01R 11/28* | (2006.01) |

(52) U.S. Cl.

CPC ..... *H01R 13/701* (2013.01); *H01R 4/4827* (2013.01); *H01R 9/24* (2013.01); *H01R 11/28* (2013.01)

(58) Field of Classification Search

None

See application file for complete search history.

(56) References Cited

U.S. PATENT DOCUMENTS 8,500,462 B2 * 8/2013 Mills ..... H01R 13/6641 439/76.1

* cited by examiner

*Primary Examiner* — Dimary Lopez Cruz

(74) *Attorney, Agent, or Firm* — Rosenberg, Klein & Lee

(57) ABSTRACT

An elastic-clip junction box structure has multidirectional wire insertion effect and holds the wires quickly. The junction box structure includes a case body and at least one conductive clip disposed in the case body. The case body is formed with a first-direction wire socket and a second-direction wire socket with different insertion directions. The conductive clip has a first-direction clip mouth in communication with the first-direction wire socket and a second-direction clip mouth in communication with the second-direction wire socket. In use, the wire can be selectively inserted into the first-direction wire socket or the second-direction wire socket. Alternatively, wires can be respectively inserted into both the first-direction wire socket and second-direction wire socket. Accordingly, wires can be selectively inserted into the elastic-clip junction box structure in multiple directions and quickly and securely held by the first-direction clip mouth and second-direction clip mouth or released therefrom.

34 Claims, 7 Drawing Sheets

ELASTIC-CLIP JUNCTION BOX STRUCTURE

BACKGROUND OF THE INVENTION

1. Field of the Invention

The present invention relates generally to an elastic-clip junction box structure, which is applied to the circuit of an electronic or electrical system/equipment for connecting wires. The elastic-clip junction box structure has multidirectional wire insertion function and is able to quickly securely hold the wires.

2. Description of the Related Art

A conventional circuit junction box is an electronic component for connecting multiple wires. The junction box is applied to the circuit system and equipment in electronic and electrical engineering field. The junction box is mainly mounted on an inner face of the operation panel or distribution chassis panel of the electronic and electrical system/equipment for connecting the layout circuits of the electronic and electrical system/equipment.

The conventional junction box generally has a wire socket formed on outer wall of the junction box. A contact terminal is disposed in the junction box in communication with the wire socket. A screw and a washer (gasket ring) are locked and assembled on the contact terminal. In use, the wire (or the terminal of the wire) is inserted into the wire socket. Then, by means of the screw, the wire is locked on the contact terminal. Such junction box is generally in the form of a switch junction box. Two sets of wire sockets and contact terminals are symmetrically disposed on the junction box for respectively inserting wires into the wire sockets. In addition, a pushbutton and a conductive member are disposed between the two contact terminals. When pressing the pushbutton, the conductive member is driven to simultaneously mate with or separate from the contact terminals so as to electrically connect or disconnect the wires and power on or off the layout circuit.

However, in the conventional junction box, each set of contact terminal only has one single wire socket. Moreover, the junction box is disposed in a narrow space of the electronic or electrical system/equipment. It is inconvenient to aim a screwdriver at the screw and rotate the screw to tighten or untighten the screw, the washer and the wire. Therefore, it is hard to perform the operation and the operation can be hardly quickly completed. Furthermore, in the conventional junction box, the wire is locked and secured by means of the screw in cooperation with the washer. In such manner, the screw is apt to loosen due to environmental shock. As a result, the wire cannot reliably contact the contact terminal or even often detaches from the contact terminal to lead to opening of the electronic circuit.

It is therefore tried by the applicant to provide an elastic-clip junction box structure to improve the shortcomings existing in the conventional junction box.

SUMMARY OF THE INVENTION

It is therefore a primary object of the present invention to provide an elastic-clip junction box structure, which has multidirectional wire insertion effect and is able to quickly securely hold the wires. The elastic-clip junction box structure overcomes the shortcoming of the conventional junction box that the wire socket is immediately adjacent to the other structure inside the equipment or the inner wall face of the equipment so that it is hard to insert the wire into the junction box. The elastic-clip junction box structure also overcomes the shortcomings of the conventional junction box that it is hard and slow to operate the screw in the narrow space of the electronic or electrical system/equipment and the screw is apt to loosen due to environmental shock to result in that the wire cannot reliably contact the contact terminal or even often detaches from the contact terminal.

To achieve the above and other objects, the elastic-clip junction box structure of the present invention includes a case body and at least one conductive clip disposed in the case body. The case body is formed with a first-direction wire socket and a second-direction wire socket with different insertion directions. The conductive clip has a first-direction clip mouth in communication with the first-direction wire socket and a second-direction clip mouth in communication with the second-direction wire socket.

In use, the wire can be selectively inserted into the first-direction wire socket or the second-direction wire socket. Alternatively, wires can be respectively inserted into both the first-direction wire socket and second-direction wire socket. Accordingly, in the narrow space of the electronic or electrical system/equipment, the wires can be selectively inserted into the elastic-clip junction box structure in multiple directions. In addition, the elastic-clip junction box structure of the present invention employs elastic conductive clip to elastically securely hold the wires instead of the screw of the conventional junction box. The wires can be quickly and securely held by the first-direction clip mouth and second-direction clip mouth of the conductive clip or released therefrom without using any hand tool such as a screwdriver to rotate the screw. Therefore, the operation is convenient and fast. Moreover, the elastic-clip junction box structure of the present invention employs the elastic conductive clip to elastically hold and secure the wire. Therefore, the poor contact or detachment of the wires due to environmental shock can be obviously reduced. Also, the structure of the conventional junction box for locking the screw can be omitted to simplify the entire structure and lower the complicity of the structure. Therefore, the manufacturing cost can be greatly lowered.

In the above elastic-clip junction box structure, the case body is formed with an internal receiving space in communication with the first-direction wire socket and the second-direction wire socket. The conductive clip is received in the receiving space. The conductive clip includes a contact terminal and a leaf spring. The contact terminal has a first conductive section extending to the first-direction wire socket and a second conductive section extending to the second-direction wire socket. The leaf spring is positioned between the first and second conductive sections. The leaf spring has a first clip section corresponding to the first-direction wire socket for elastically pushing the first conductive section and a second clip section corresponding to the second-direction wire socket for elastically pushing the second conductive section. The first-direction clip mouth is formed between the first clip section and the first conductive section. The second-direction clip mouth is formed between the second clip section and the second conductive section. When it is desired to remove the wire held in the first-direction clip mouth or the second-direction clip mouth, a hand tool such as a screwdriver or a slender piece can be inserted through the first-direction wire socket or the second-direction wire socket to push the first clip section or the second clip section to elastically swing so as to open the first clip section or the second clip section to release the wire and permit the wire to be extracted out of the first-direction wire socket or the second-direction wire socket.

In the above elastic-clip junction box structure, a perforation is formed beside at least one of the first-direction wire socket and the second-direction wire socket. The perforation is directed to at least one of the first and second clip sections of the leaf spring. Accordingly, when it is desired to remove the wire held in the first-direction clip mouth or the second-direction clip mouth, a hand tool such as a screwdriver or a slender piece can be inserted through the perforation into the case body to push the first clip section or the second clip section to elastically swing so as to open the first clip section or the second clip section to release the wire and permit the wire to be extracted out of the first-direction wire socket or the second-direction wire socket.

In the above elastic-clip junction box structure, the first clip section extends from the first-direction wire socket to the first conductive section, while the second clip section extends from the second-direction wire socket to the second conductive section.

In the above elastic-clip junction box structure, a leaf spring stop section is disposed in the case body for securely holding the leaf spring. The leaf spring stop section is formed with an opening directed to the first-direction clip mouth and the second-direction clip mouth to provide an elastic swinging space for the first and second clip sections.

In the above elastic-clip junction box structure, multiple recessed sections are arranged on a surface of one of the first conductive section and the second conductive section of the conductive terminal at intervals. Accordingly, by means of the recessed sections, the first and second conductive sections can interfere with the wires to securely hold the wires in the first-direction clip mouth and the second-direction clip mouth.

In the above elastic-clip junction box structure, a terminal stop section is disposed in the case body. The terminal stop section is correspondingly disposed at an innermost end of a wire insertion path between the first-direction clip mouth and the second-direction clip mouth. The terminal stop section serves to securely hold the contact terminal.

In the above elastic-clip junction box structure, the number of one of the first-direction wire socket and the second-direction wire socket is a multiplicity and the multiple first-direction wire sockets or multiple second-direction wire sockets are side by side arranged on the case body. Accordingly, in each wire insertion direction, multiple wires can be inserted into the case body to enhance practical effect.

In the above elastic-clip junction box structure, there are multiple sets of conductive clips, first-direction wire sockets and second-direction wire sockets.

In the above elastic-clip junction box structure, the case body has a front end section, a rear end section opposite to the front end section and two lateral end sections positioned between the front end section and the rear end section. The first-direction clip mouth is disposed on the front end section. The second-direction clip mouth is disposed on the lateral end sections. The case body is further formed with an internal guide passage passing through the case body between the front and rear end sections. A pushbutton is slidably disposed in the guide passage. A conductive member is movable along with the pushbutton to simultaneously mate with or separate from the respective conductive clips. At least one elastic unit is disposed between the guide passage and the pushbutton. The elastic unit serves to urge the pushbutton to drive the conductive member to mate with or separate from the respective conductive clips.

In the above elastic-clip junction box structure, the angle contained between the first and second conductive sections is equal to or smaller than 90 degrees. A conductive mating section is disposed at one end of the second conductive section distal from the first conductive section. The angle contained between the second conductive section and the mating section is equal to or smaller than 90 degrees. The angle contained between the first and second conductive sections is reverse to the angle contained between the second conductive section and the mating section. The mating section is bent toward the first conductive section to contain an angle directed to the second conductive section.

The present invention can be best understood through the following description and accompanying drawings, wherein:

DETAILED DESCRIPTION OF THE PREFERRED EMBODIMENTS

Figure 1:
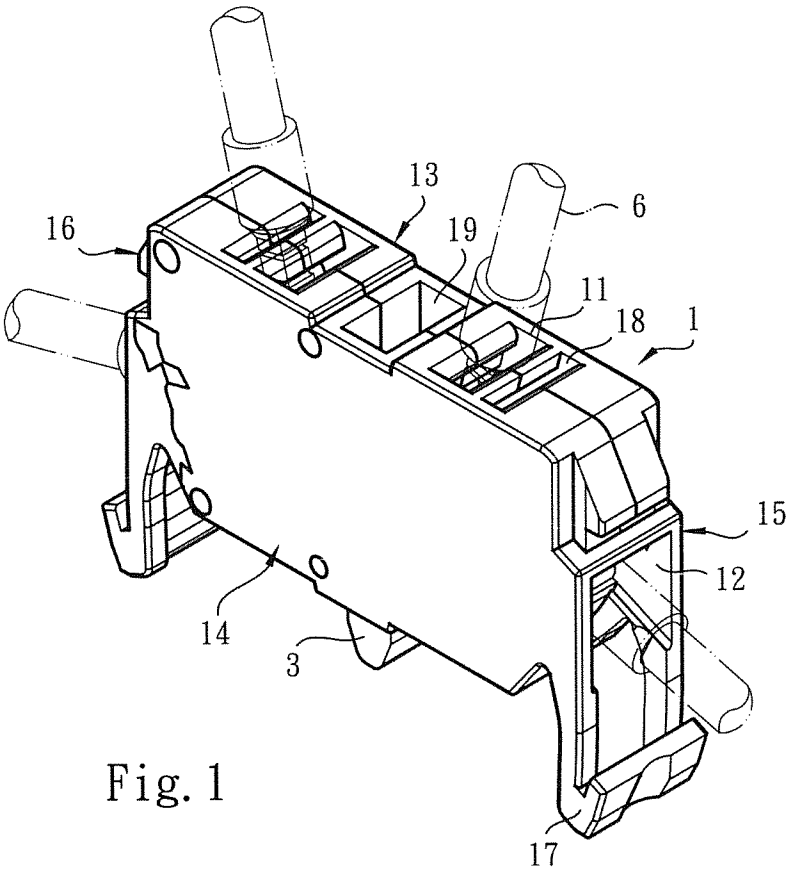
FIG. 1 is a perspective assembled view of a preferred embodiment of the present invention.

Please refer to FIGS. 1 to 4. The elastic-clip junction box structure of the present invention includes a case body 1 and at least one conductive clip 2 disposed in the case body 1. The case body 1 is formed with a first-direction wire socket 11 and a second-direction wire socket 12 with different insertion directions (such as a longitudinal direction and a transverse direction). The conductive clip 2 has a first-direction clip mouth 21 and a second-direction clip mouth 22. The first-direction clip mouth 21 communicates with the first-direction wire socket 11, while the second-direction clip mouth 22 communicates with the second-direction wire socket 12. As shown in the drawings, the case body 1 has a front end section 13, a rear end section 14 opposite to the front end section 13 and two lateral end sections 15, 16 positioned between the front end section 13 and the rear end section 14. The first-direction clip mouth 21 can be disposed on the front end section 13, while the second-direction clip mouth 22 can be disposed on the lateral end sections 15, 16. A hook section 17 is disposed at each of the lateral end sections 15, 16 and extends in a direction to the rear end section 14. The hook sections 17 provide assembling and fixing effect for the case body 1.

Figure 2:
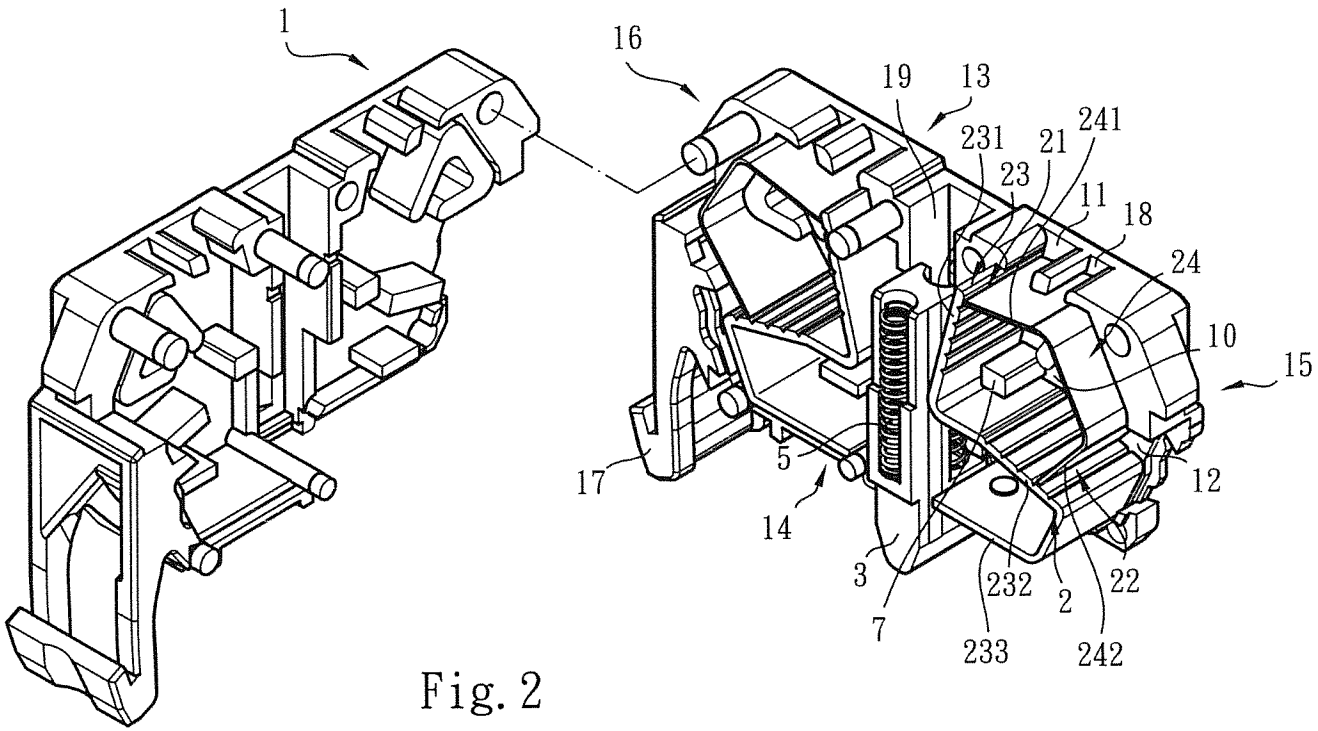
FIG. 2 is a perspective exploded view of the preferred embodiment of the present invention according to FIG. 1.
Figure 3:
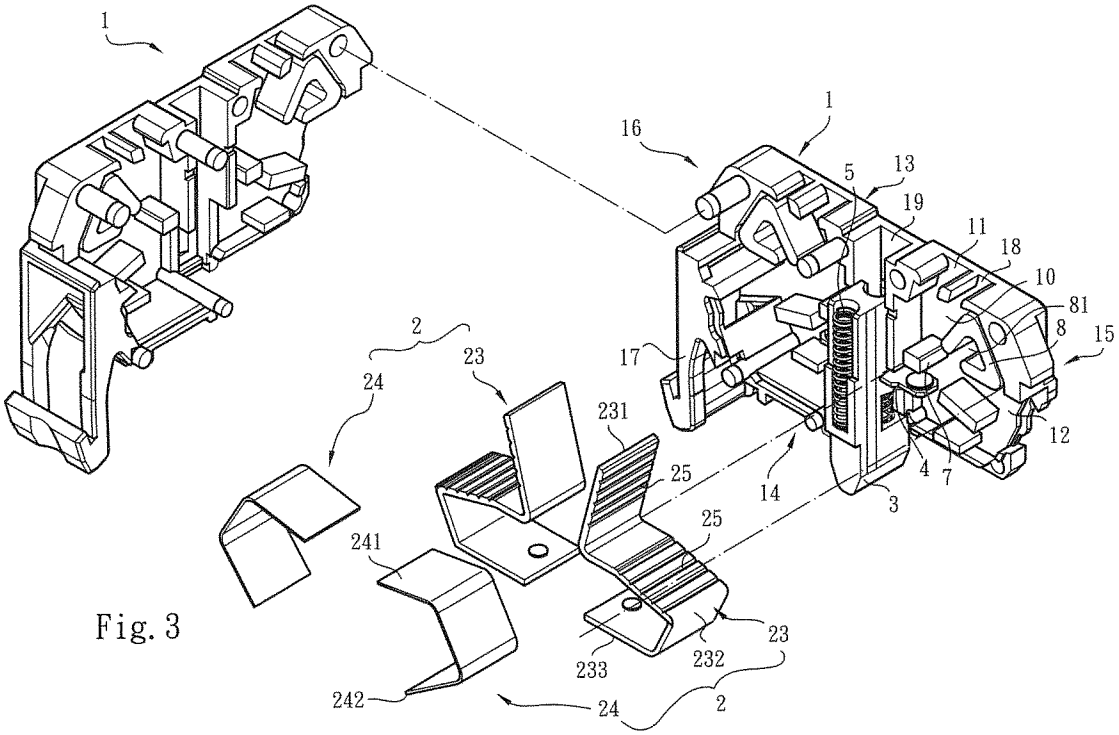
FIG. 3 is a perspective further exploded view of the preferred embodiment of the present invention according to FIG. 2.
Figure 4:
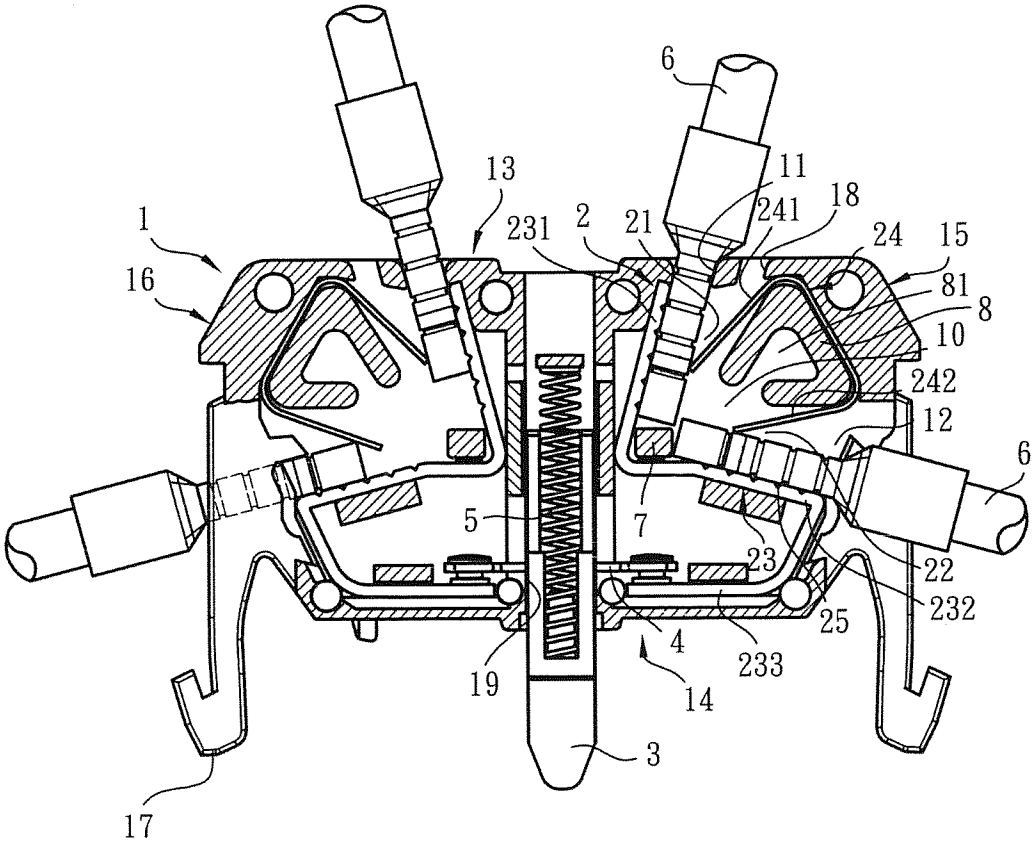
FIG. 4 is a sectional view according to FIG. 1.

As shown in FIGS. 2 to 4, to speak more specifically, the case body 1 is formed with an internal receiving space 10 in communication with the first-direction wire socket 11 and the second-direction wire socket 12. The conductive clip 2 is fixedly received in the receiving space 10. The conductive clip 2 includes a bending contact terminal 23 and a bending leaf spring 24. Two ends of the contact terminal 23 are respectively formed with a plate-shaped first conductive section 231 and a plate-shaped second conductive section 232. The first conductive section 231 extends to the first-direction wire socket 11, while the second conductive section 232 extends to the second-direction wire socket 12.

The leaf spring 24 is positioned between the first and second conductive sections 231, 232. Two ends of the leaf spring 24 are respectively formed with a plate-shaped first clip section 241 and a plate-shaped second clip section 242. The first clip section 241 extends from the first-direction wire socket 11 to the first conductive section 231. A middle portion of the first clip section 241 is aligned with the first-direction wire socket 11. The free end of the first clip section 241 elastically pushes the first conductive section 231. The second clip section 242 extends from the second-direction wire socket 12 to the second conductive section 232. A middle portion of the second clip section 242 is aligned with the second-direction wire socket 12. The free end of the second clip section 242 elastically pushes the second conductive section 232. The first-direction clip mouth 21 is formed between the first clip section 241 and the first conductive section 231, while the second-direction clip mouth 22 is formed between the second clip section 242 and the second conductive section 232.

A terminal stop section 7 is disposed in the receiving space 10 of the case body 1 for securely holding the contact terminal 23. A leaf spring stop section 8 is also disposed in the receiving space 10 for securely holding the leaf spring 24. The terminal stop section 7 can be correspondingly disposed at an innermost end of the wire insertion path between the first-direction clip mouth 21 and the second-direction clip mouth 22. The contact terminal 23 is fixedly inlaid between the terminal stop section 7 and an inner wall of the case body 1. The leaf spring stop section 8 is positioned between the first-direction wire socket 11 and the second-direction wire socket 12. The leaf spring 24 is fixedly inlaid between the leaf spring stop section 8 and the inner wall of the case body 1. The leaf spring stop section 8 is formed with an opening 81 directed to the first-direction clip mouth 21 and the second-direction clip mouth 22 to provide an elastic swinging space for the first and second clip sections 241, 242.

A perforation 18 is formed beside the first-direction wire socket 11 and directed to the first clip section 241. Alternatively, a perforation is formed beside the second-direction wire socket 12 and directed to the second clip section 242. In this embodiment, the perforation 18 is formed beside the first-direction wire socket 11 and the diameter of the second-direction wire socket 12 is enlarged.

In use, a wire 6 (or a terminal of the wire 6) is selectively inserted into the first-direction wire socket 11 or the second-direction wire socket 12. Alternatively, the wires 6 can be respectively inserted into the first-direction wire socket 11 and the second-direction wire socket 12. When the wire 6 is inserted through the first-direction wire socket 11 into the first-direction clip mouth 21, the front end of the wire 6 can push the first clip section 241 to force the first clip section 241 to elastically bend and swing so as to open the first-direction clip mouth 21. When the front end of the wire 6 extends into the first-direction clip mouth 21, the first clip section 241 can elastically swing toward the first conductive section 231 and restore to press the wire 6 against the surface of the first conductive section 231. Under such circumstance, the first clip section 241 and the first conductive section 231 together securely hold the wire 6 in the first-direction clip mouth 21. Similarly, the second clip section 242 and the second conductive section 232 can together securely hold another wire 6 in the second-direction clip mouth 22. At this time, two lateral sides of the same corner of the terminal stop section 7 serve to respectively stop the front ends of the wires 6 inserted into the first-direction clip mouth 21 and/or the second-direction clip mouth 22. Accordingly, the terminal stop section 7 is interposed between the wires 6 inserted into the first-direction clip mouth 21 and the second-direction clip mouth 22 to interfere with or press the wires 6.

It should be noted that when the case body 1 is disposed in a narrow space of an electronic or electrical system/equipment, the first-direction wire socket 11 or the second-direction wire socket 12 of the case body 1 will be immediately adjacent to the other structure inside the equipment or the inner wall face of the equipment. The first-direction wire socket 11 and the second-direction wire socket 12 are disposed on the case body 1 with different insertion directions. Therefore, it is easy to adjust at least one of the first-direction wire socket 11 and the second-direction wire socket 12 to be directed in a direction not immediately adjacent to the other structure inside the equipment or the inner wall face of the equipment. Accordingly, multiple insertion directions of the wires 6 can be selected in the narrow space of the electronic or electrical system/equipment. In this case, the wires 6 can be conveniently inserted into the wire sockets of the junction box.

In addition, the present invention improves the wire connection manner of the conventional junction box. The present invention employs the conductive clips 2 to elastically clip and secure the wires 6. By means of the first-direction clip mouth 21 and the second-direction clip mouth 22 of the conductive clip 2, the wires 6 can be quickly securely held and released. It is unnecessary to use any hand tool such as a screwdriver to aim at the screw and rotate the screw. Therefore, the operation of the present invention is convenient and fast.

Figure 5:
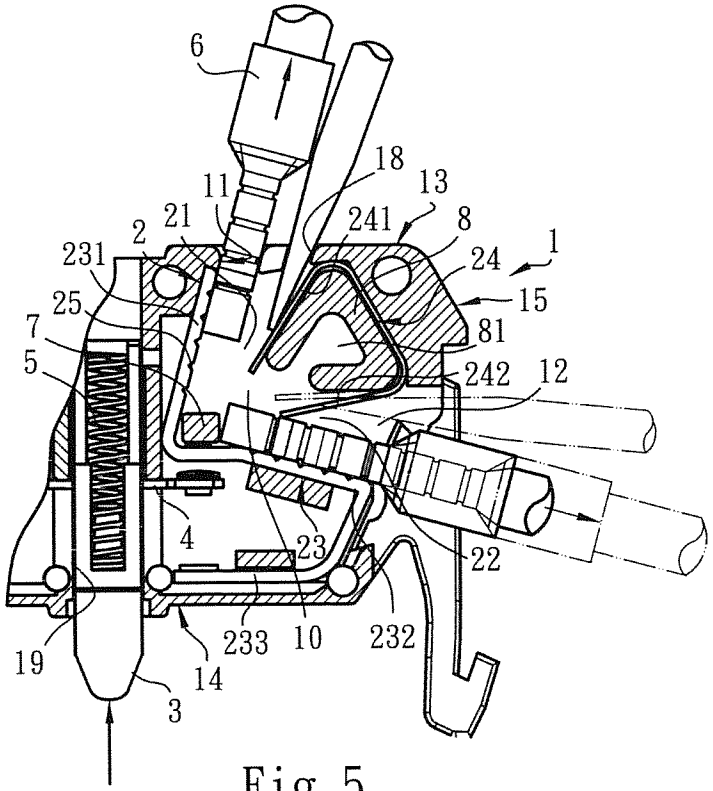
FIG. 5 is a sectional view according to FIG. 4, showing the use of the preferred embodiment of the present invention.

As shown in FIG. 5, when it is desired to remove the wire 6 held in the first-direction clip mouth 21, a hand tool such as a screwdriver or a slender piece can be inserted through the perforation 18 into the case body 1 to push the first clip section 241 to elastically swing so as to release the wire 6 to be extracted out of the first-direction wire socket 11. When it is desired to remove the wire 6 held in the second-direction clip mouth 22, a hand tool such as a screwdriver or a slender piece can be also inserted through the second-direction wire socket 12 with the enlarged diameter into the case body 1 to push the second clip section 242 to elastically swing so as to release the wire 6 to be extracted out of the second-direction wire socket 12. Accordingly, the operation of the present invention is fast and convenient.

It should be noted that the present invention employs the conductive clip 2 to elastically hold and secure the wire 6. The conductive clip 2 has stretching/contracting elasticity to buffer the shocking force. Therefore, the poor contact or detachment of the wire 6 due to environmental shock can be obviously reduced. Also, the structure of the conventional junction box for locking the screw can be omitted to simplify the entire structure and lower the complicity of the structure. Therefore, the manufacturing cost can be greatly lowered.

In the preferred embodiment, the contact terminal 23 is formed with multiple recessed sections 25 arranged on the surfaces of the first conductive section 231 and/or the second conductive section 232 at intervals. Accordingly, by means of the recessed sections 25, the first and second conductive sections 231, 232 can interfere with the wires 6 to securely hold the wires 6 in the first-direction clip mouth 21 and the second-direction clip mouth 22. This can further enhance the holding security of the wires 6.

In another embodiment, there are multiple contact terminals 23, multiple leaf springs 24, multiple first-direction wire sockets 11 and multiple second-direction wire sockets 12 respectively disposed on left and right sides of the case body 1. The case body 1 is further formed with an internal guide passage 19 passing through the case body 1 between the front and rear end sections 13, 14 thereof. A pushbutton 3 is slidably disposed in the guide passage 19. A conductive member 4 is movable along with the pushbutton 3. The conductive member 4 is drivable by the pushbutton 3 to simultaneously mate with or separate from the contact terminals 23 of the respective conductive clips 2, whereby the conductive clips 2 can be electrically connected with each other via the conductive member 4.

In this embodiment, the guide passage 19 is interposed between the two sets of conductive clips 2. At least one elastic unit 5 is disposed between the guide passage 19 and the pushbutton 3. The elastic unit 5 can be a spring. The elastic unit 5 is able to elastically urge the pushbutton 3 to drive the conductive member 4 to simultaneously mate with or separate from the contact terminals 23 of the respective conductive clips 2. The angle contained between the first and second conductive sections 231, 232 is equal to or smaller than 90 degrees. A conductive mating section 233 bendingly extends from one end of the second conductive section 232 distal from the first conductive section 231 toward the rear end section 14. The angle contained between the second conductive section 232 and the mating section 233 is equal to or smaller than 90 degrees. In addition, the angle contained between the first and second conductive sections 231, 232 is reverse to the angle contained between the second conductive section 232 and the mating section 233. Accordingly, the mating section 233 is positioned in the moving path of the conductive member 4. The mating section 233 can be further bent toward the first conductive section 231, whereby a middle portion of the mating section 233 is bent to define an angle directed to the second conductive section 232.

Accordingly, the junction box structure of the present invention can have the form of a switch junction box. By means of changing the angles contained between the first and second conductive sections 231, 232 and the mating section 233, the structure of the contact terminal 23 can be simplified and the occupied arrangement space can be minified without interference between the wires inserted into the case body 1 in different directions. Moreover, the first and second conductive sections 231, 232 and the mating section 233 of the contact terminal 23 can be formed of one single conductive metal plate by bending or assembled from multiple conductive metal plates. When pressing the pushbutton 3, two ends of the conductive member 4 are both driven to simultaneously mate with or separate from the mating sections 233 of the respective conductive clips 2, whereby the respective wires 6 can be electrically connected with each other or disconnected from each other so as to power on or power off the layout circuit.

Figure 6:
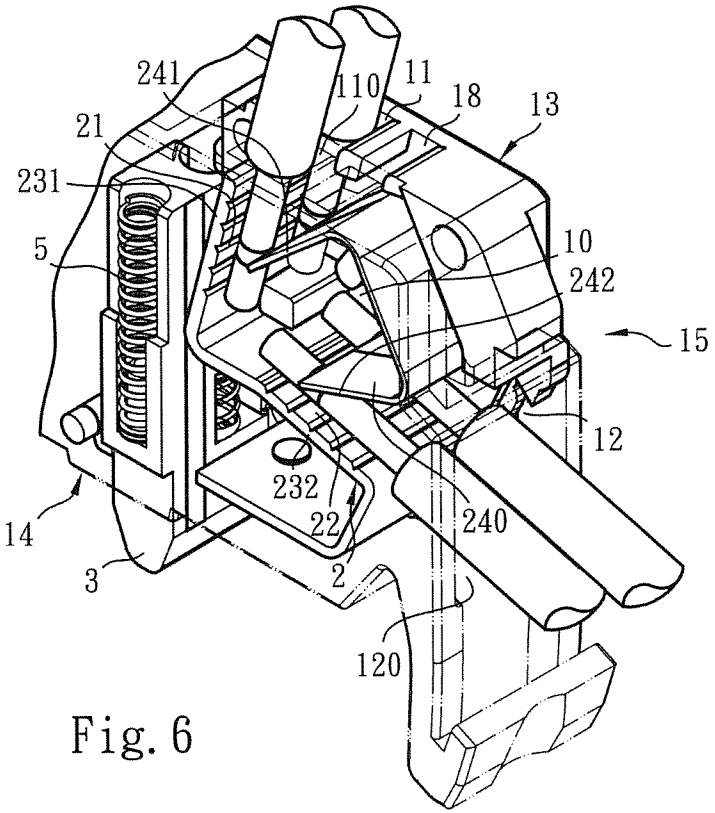
FIG. 6 is a perspective assembled view of another preferred embodiment of the present invention according to FIG. 1.
Figure 7:
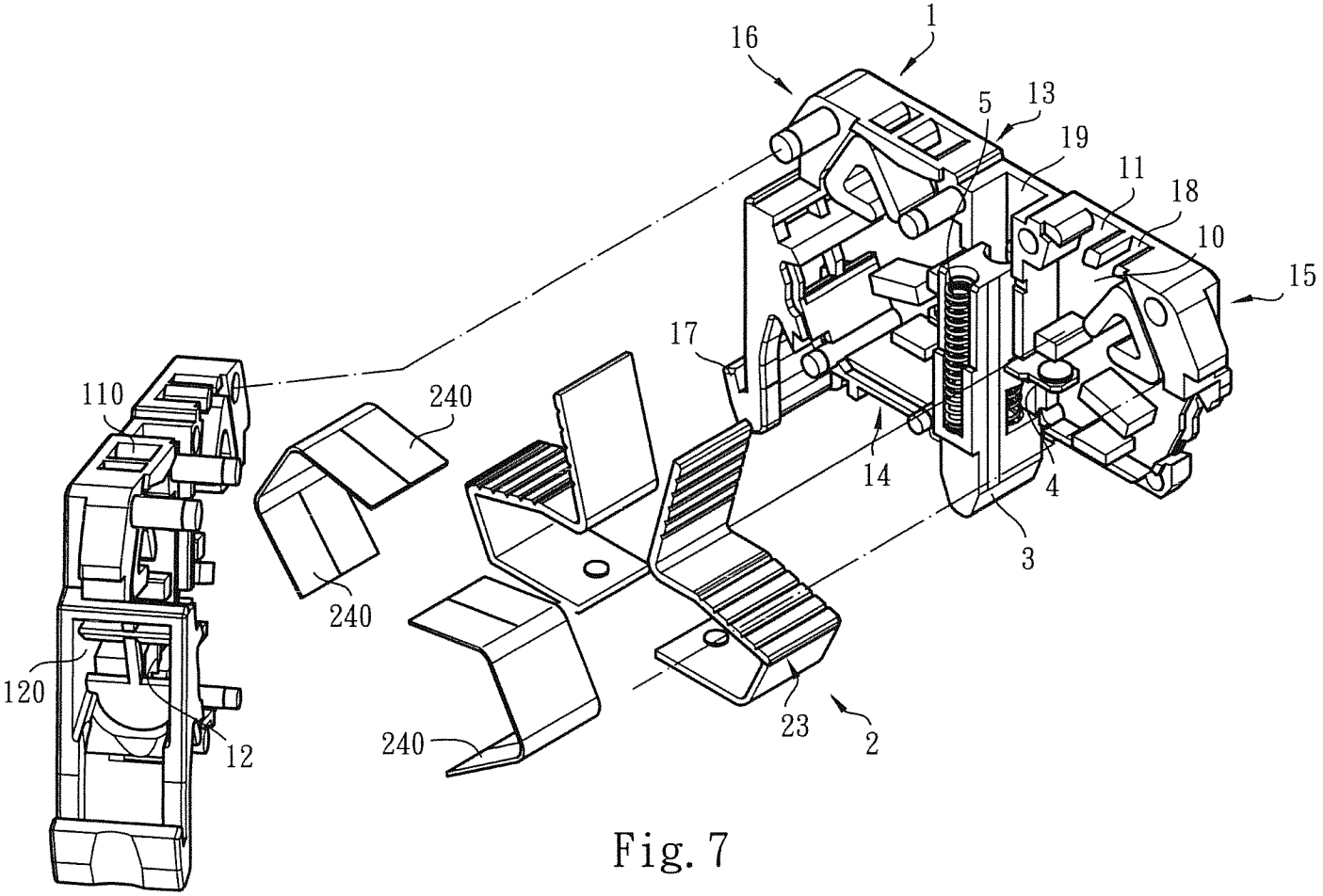
FIG. 7 is a perspective exploded view of the other preferred embodiment of the present invention according to FIG. 6.

Please now refer to FIGS. 6 and 7. In a modified embodiment, there are multiple first-direction wire sockets 11, 110 and/or multiple second-direction wire sockets 12, 120 side by side arranged on the case body 1. There are also multiple leaf springs 240 side by side positioned in the case body 1. The first-direction wire sockets 11, 110 communicate with the first-direction clip mouth 21 in common, while the second-direction wire sockets 12, 120 communicate with the second-direction clip mouth 22 in common. Accordingly, in each wire insertion direction, multiple wires 6 can be inserted into the case body 1 to enhance practical effect.

In conclusion, the elastic-clip junction box structure of the present invention is effective and different from the conventional electrical connection terminal in space form. The elastic-clip junction box structure of the present invention is inventive and greatly advanced and advantageous over the conventional junction box.

The above embodiments are only used to illustrate the present invention, not intended to limit the scope thereof. Many modifications of the above embodiments can be made without departing from the spirit of the present invention.

What is claimed is:

1. An elastic-clip junction box structure comprising a case body and at least one conductive clip disposed in the case body, the case body being formed with a first-direction wire socket and a second-direction wire socket with different insertion directions, the conductive clip having a first-direction clip mouth in communication with the first-direction wire socket and a second-direction clip mouth in communication with the second-direction wire socket;

wherein the case body is formed with an internal receiving space in communication with the first-direction wire socket and the second-direction wire socket, the conductive clip being received in the receiving space, the conductive clip including a contact terminal and a leaf spring, the contact terminal having a first conductive section extending to the first-direction wire socket and a second conductive section extending to the second-direction wire socket; and the leaf spring having a first clip section corresponding to first conductive section and a second clip section corresponding to the second conductive section.

2. The elastic-clip junction box structure as claimed in claim 1, wherein the leaf spring is positioned between the first and second conductive sections, the first clip section corresponding to the first-direction wire socket for elastically pushing the first conductive section and the second clip section corresponding to the second-direction wire socket for elastically pushing the second conductive section, the first-direction clip mouth being formed between the first clip section and the first conductive section, the second-direction clip mouth being formed between the second clip section and the second conductive section.

3. The elastic-clip junction box structure as claimed in claim 2, wherein the first clip section extends from the first-direction wire socket to the first conductive section, while the second clip section extends from the second-direction wire socket to the second conductive section.

4. The elastic-clip junction box structure as claimed in claim 2, wherein a leaf spring stop section is disposed in the case body for securely holding the leaf spring, the leaf spring stop section being formed with an opening directed to the first-direction clip mouth and the second-direction clip mouth to provide an elastic swinging space for the first and second clip sections.

5. The elastic-clip junction box structure as claimed in claim 2, wherein the number of one of the first-direction wire socket and the second-direction wire socket is a multiplicity and the multiple first-direction wire sockets or multiple second-direction wire sockets are side by side arranged on the case body.

6. The elastic-clip junction box structure as claimed in claim 5, wherein there are multiple sets of conductive clips, first-direction wire sockets and second-direction wire sockets.

7. The elastic-clip junction box structure as claimed in claim 5, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

8. The elastic-clip junction box structure as claimed in claim 2, wherein the case body has a front end section, a rear end section opposite to the front end section and two lateral end sections positioned between the front end section and the rear end section, the first-direction clip mouth being disposed on the front end section, the second-direction clip mouth being disposed on the lateral end sections, the case body being further formed with an internal guide passage passing through the case body between the front and rear end sections, a pushbutton being slidably disposed in the guide passage, a conductive member being movable along with the pushbutton to simultaneously mate with or separate from the respective conductive clips.

9. The elastic-clip junction box structure as claimed in claim 1, wherein the case body has a front end section, a rear end section opposite to the front end section and two lateral end sections positioned between the front end section and the rear end section, the first-direction clip mouth being disposed on the front end section, the second-direction clip mouth being disposed on the lateral end sections, the case body being further formed with an internal guide passage passing through the case body between the front and rear end sections, a pushbutton being slidably disposed in the guide passage, a conductive member being movable along with the pushbutton to simultaneously mate with or separate from the respective conductive clips.

10. The elastic-clip junction box structure as claimed in claim 8, wherein at least one elastic unit is disposed between the guide passage and the pushbutton, the elastic unit serving to urge the pushbutton to drive the conductive member to mate with or separate from the respective conductive clips.

11. The elastic-clip junction box structure as claimed in claim 8, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

12. The elastic-clip junction box structure as claimed in claim 2, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

13. The elastic-clip junction box structure as claimed in claim 12, wherein the mating section is bent toward the first conductive section to contain an angle directed to the second conductive section.

14. The elastic-clip junction box structure as claimed in claim 1, wherein a perforation is formed beside at least one of the first-direction wire socket and the second-direction wire socket, the perforation being directed to at least one of the first and second clip sections.

15. The elastic-clip junction box structure as claimed in claim 1, wherein multiple recessed sections are arranged on a surface of one of the first conductive section and the second conductive section of the conductive terminal at intervals.

16. The elastic-clip junction box structure as claimed in claim 1, wherein a terminal stop section is disposed in the case body, the terminal stop section being correspondingly disposed at an innermost end of a wire insertion path between the first-direction clip mouth and the second-direction clip mouth.

17. The elastic-clip junction box structure as claimed in claim 16, wherein the terminal stop section serves to securely hold the contact terminal.

18. The elastic-clip junction box structure as claimed in claim 1, wherein the number of one of the first-direction wire socket and the second-direction wire socket is a multiplicity and the multiple first-direction wire sockets or multiple second-direction wire sockets are side by side arranged on the case body.

19. The elastic-clip junction box structure as claimed in claim 18, wherein there are multiple sets of conductive clips, first-direction wire sockets and second-direction wire sockets.

20. The elastic-clip junction box structure as claimed in claim 18, wherein the case body has a front end section, a rear end section opposite to the front end section and two lateral end sections positioned between the front end section and the rear end section, the first-direction clip mouth being disposed on the front end section, the second-direction clip mouth being disposed on the lateral end sections, the case body being further formed with an internal guide passage passing through the case body between the front and rear end sections, a pushbutton being slidably disposed in the guide passage, a conductive member being movable along with the pushbutton to simultaneously mate with or separate from the respective conductive clips.

21. The elastic-clip junction box structure as claimed in claim 20, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

22. The elastic-clip junction box structure as claimed in claim 21, wherein the mating section is bent toward the first conductive section to contain an angle directed to the second conductive section.

23. The elastic-clip junction box structure as claimed in claim 18, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

24. The elastic-clip junction box structure as claimed in claim 23, wherein the mating section is bent toward the first conductive section to contain an angle directed to the second conductive section.

25. The elastic-clip junction box structure as claimed in claim 9, wherein at least one elastic unit is disposed between the guide passage and the pushbutton, the elastic unit serving to urge the pushbutton to drive the conductive member to mate with or separate from the respective conductive clips.

26. The elastic-clip junction box structure as claimed in claim 9, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

27. The elastic-clip junction box structure as claimed in claim 26, wherein the mating section is bent toward the first conductive section to contain an angle directed to the second conductive section.

28. The elastic-clip junction box structure as claimed in claim 1, wherein an angle contained between the first and second conductive sections is equal to or smaller than 90 degrees, a conductive mating section being disposed at one end of the second conductive section distal from the first conductive section, an angle contained between the second conductive section and the mating section being equal to or smaller than 90 degrees, the angle contained between the first and second conductive sections being reverse to the angle contained between the second conductive section and the mating section.

29. The elastic-clip junction box structure as claimed in claim 28, wherein the mating section is bent toward the first conductive section to contain an angle directed to the second conductive section.

30. An elastic-clip junction box structure comprising a case body and at least one conductive clip disposed in the case body, the case body being formed with a first-direction wire socket and a second-direction wire socket with different insertion directions, the conductive clip having a first-direction clip mouth in communication with the first-direction wire socket and a second-direction clip mouth in communication with the second-direction wire socket;

wherein the number of one of the first-direction wire socket and the second-direction wire socket is a multiplicity and the multiple first-direction wire sockets or multiple second-direction wire sockets are side by side arranged on the case body.

31. The elastic-clip junction box structure as claimed in claim 30, wherein there are multiple sets of conductive clips, first-direction wire sockets and second-direction wire sockets.

32. The elastic-clip junction box structure as claimed in claim 30, wherein the case body has a front end section, a rear end section opposite to the front end section and two lateral end sections positioned between the front end section and the rear end section, the first-direction clip mouth being disposed on the front end section, the second-direction clip mouth being disposed on the lateral end sections, the case body being further formed with an internal guide passage passing through the case body between the front and rear end sections, a pushbutton being slidably disposed in the guide passage, a conductive member being movable along with the pushbutton to simultaneously mate with or separate from the respective conductive clips.

33. An elastic-clip junction box structure comprising a case body and at least one conductive clip disposed in the case body, the case body being formed with a first-direction wire socket and a second-direction wire socket with different insertion directions, the conductive clip having a first-direction clip mouth in communication with the first-direction wire socket and a second-direction clip mouth in communication with the second-direction wire socket;

wherein the case body has a front end section, a rear end section opposite to the front end section and two lateral end sections positioned between the front end section and the rear end section, the first-direction clip mouth being disposed on the front end section, the second-direction clip mouth being disposed on the lateral end sections, the case body being further formed with an internal guide passage passing through the case body between the front and rear end sections, a pushbutton being slidably disposed in the guide passage, a conductive member being movable along with the pushbutton to simultaneously mate with or separate from the respective conductive clips.

34. The elastic-clip junction box structure as claimed in claim 33, wherein at least one elastic unit is disposed between the guide passage and the pushbutton, the elastic unit serving to urge the pushbutton to drive the conductive member to mate with or separate from the respective conductive clips.

* * * * *